US007530789B1

(12) United States Patent
Liang

(10) Patent No.: US 7,530,789 B1
(45) Date of Patent: May 12, 2009

(54) TURBINE BLADE WITH A SERPENTINE FLOW AND IMPINGEMENT COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 389 days.

(21) Appl. No.: 11/600,448

(22) Filed: Nov. 16, 2006

(51) Int. Cl.
*F01D 5/16* (2006.01)

(52) U.S. Cl. ..... 416/97 R; 416/96 R; 416/95; 415/115

(58) Field of Classification Search ..... 415/115, 415/116; 416/90 R, 92, 96 R, 97 R, 95
See application file for complete search history.

(56) References Cited

U.S. PATENT DOCUMENTS

| | | | | |
|---|---|---|---|---|
| 5,165,852 | A | 11/1992 | Lee et al. | |
| 5,253,976 | A | 10/1993 | Cunha | |
| 5,498,133 | A | 3/1996 | Lee | |
| 5,538,394 | A | 7/1996 | Inomata et al. | |
| 5,660,524 | A | 8/1997 | Lee et al. | |
| 5,813,836 | A | 9/1998 | Starkweather | |
| 6,036,441 | A | 3/2000 | Manning et al. | |
| 6,039,537 | A | 3/2000 | Scheurlen | |
| 6,129,515 | A | 10/2000 | Soechting et al. | |
| 6,168,381 | B1 | 1/2001 | Reddy | |
| 6,206,638 | B1 | 3/2001 | Glynn et al. | |
| 6,273,682 | B1 | 8/2001 | Lee | |
| 6,514,042 | B2 * | 2/2003 | Kvasnak et al. | 416/97 R |
| 6,595,748 | B2 | 7/2003 | Flodman et al. | |
| 6,705,836 | B2 | 3/2004 | Bourriaud et al. | |
| 6,832,889 | B1 * | 12/2004 | Lee et al. | 415/115 |
| 6,837,683 | B2 | 1/2005 | Dailey | |
| 6,916,155 | B2 | 7/2005 | Eneau et al. | |
| 7,131,818 | B2 * | 11/2006 | Cunha et al. | 416/97 R |

* cited by examiner

*Primary Examiner*—Edward Look
*Assistant Examiner*—Dwayne J White
(74) *Attorney, Agent, or Firm*—John Ryznic

(57) ABSTRACT

A turbine blade with a film cooling holes arrangement to supply film cooling to hot sections on the pressure side and suction side of the blade. The cooling flow circuit for the blade uses a serpentine flow cooling path to supply cooling air to a number of impingement cavities, the impingement cavities being connected to film cooling holes to discharge film cooling air to key spots on the pressure side wall and suction side wall of the blade that require film cooling air. The serpentine flow cooling channels are located on the opposite side of the blade from the impingement cavity in which the channel communicates with through metering and impingement holes. The first and second legs of the serpentine flow cooling channels are located on the pressure side, and the third leg or channel is located on the suction side of the blade downstream from the gage point and where no further film cooling is preferred. By moving the serpentine flow cooling supply channel from the pressure side to the suction side in the third leg, the film cooling holes on the pressure side of the blade can be supplied through metering holes and an impingement cavity that discharge the film cooling air. The remaining legs of the serpentine flow cooling supply channels are in the trailing edge region of the blade, and a plurality of exit holes discharge cooling air from the last leg of the cooling supply channels.

11 Claims, 1 Drawing Sheet

TURBINE BLADE WITH A SERPENTINE FLOW AND IMPINGEMENT COOLING CIRCUIT

CROSS-REFERENCE TO RELATED APPLICATIONS

This application is related to co-pending U.S. patent application Ser. No. 11/472,249 filed on Jun. 21, 2006 and entitled TURBINE AIRFOIL WITH A SERPENTINE FLOW PATH; co-pending U.S. patent application Ser. No. 11/503,547 filed on Aug. 11, 2006 and entitled COMPARTMENT COOLED TURBINE BLADE; co-pending U.S. patent application Ser. No. 11/584,479 filed on Oct. 19, 2006 and entitled TURBINE BLADE WITH TRIPLE PASS SERPENTINE FLOW COOLING CIRCUIT.

BACKGROUND OF THE INVENTION

1. Field of the Invention

The present invention relates generally to fluid reaction surfaces, and more specifically to turbine airfoils with a cooling circuit.

2. Description of the Related Art Including Information Disclosed Under 37 CFR 1.97 and 1.98

A gas turbine engine is a very efficient way for converting combustion into mechanical energy used to produce electrical power. A gas turbine engine includes a compressor to compress air, a combustor to mix the compressed air with a fuel and generate a hot gas flow, and a turbine to receive the hot gas flow and drive the turbine shaft. A typical turbine in an industrial gas turbine engine (IGT) will use four stages of stator vanes and rotor blades to progressively convert the energy of the hot gas flow into mechanical energy. A turbine has a temperature operating limit based upon the hottest temperature that the first stage vanes and blades can withstand without damage. The engine efficiency can be increased by increasing the hot gas flow into the turbine. It is therefore desirable to allow for a higher gas flow temperature in the turbine to produce more power using less fuel.

One method of increasing the efficiency of the engine is to provide for internal air cooling of the first stage vanes and blades. Even though the materials have not changed, the air cooled airfoils (blades and vanes) will allow for a higher temperature flow and therefore an increase in the engine efficiency. The cooling circuit includes internal channels and cavities for conductive cooling of the blade and film cooling holes on the airfoil surface that provide a blanket of cooling air between the hot gas flow and the airfoil surface. in film cooling, the cooling air must be channeled through the airfoils with a high enough pressure to prevent blowback ingestion of the hot gas flow through the film cooling holes, and also avoid excessive pressure drop across the film cooling holes which would tend to separate the film of cooling air from the outer surface of the airfoil which would degrade the film cooling effectiveness.

On a turbine blade with a pressure side and a suction side, certain surface areas require film cooling while others can make due with the convective cooling from the flow of cooling air in the through path channel such as a leg of the serpentine flow circuit. this is especially true for the first and second legs of the serpentine flow circuit, since the cooling air entering these channels is fresh air that have not been heated too much.

Another method of improving the engine efficiency is to use less cooling air in the airfoils to provide the same amount of cooling. The compressed air used as the cooling air is typically air bled off from the compressor. Energy is required to compress the cooling air, and therefore energy is lost and the engine efficiency is lowered. Complex internal air cooling circuitry has been proposed to provide a maximum amount of cooling while using a minimum amount of cooling air. The locations of film cooling holes are strategically placed to provide film cooling to hot spots on the airfoil walls. Cooling air pressures are regulated due to different external flow pressures over the airfoil walls. The external pressure is higher on the pressure side than it is on the suction side, while the hottest region on the airfoil surface appears on the suction side than on the pressure side. Thus, there is always a desire to improve on the prior art internal airfoil cooling air circuitry to provide the maximum amount of cooling while using the minimum amount of cooling air.

U.S. Pat. No. 6,705,836 B2 issued to Bourriaud et al on Mar. 16, 2004 and entitled GAS TURBINE BLADE COOLING CIRCUITS discloses a turbine blade with multiple serpentine flowing cooling circuits separate from one another. One serpentine circuit is on the pressure side of the mid-chord portion, a second serpentine flow circuit is in the trailing edge region, a third serpentine flow circuit is on the suction side at the mid-chord portion, and a central cooling supply channel is between the pressure side and suction side serpentine flow circuits and supplies cooling air to the showerhead arrangement.

U.S. Pat. No. 6,039,537 issued to Scheurlen on Mar. 21, 2000 entitled TURBINE BLADE WHICH CAN BE SUBJECTED TO A HOT GAS FLOW discloses a turbine blade with a series of cooling channels extending from the leading edge region to the trailing edge region, each channel extending from the pressure side wall to the suction side wall to provide near wall cooling for both the pressure and suction sides. One of these channels includes film cooling holes extending onto the pressure side wall and the suction side wall of the blade. One problem with this particular design is that the cooling air supply pressure for the suction side film cooling holes is the same pressure as the pressure side film cooling holes. since the external pressure on the pressure side is higher than the external pressure on the suction side, either too much cooling air is discharged out the suction side film cooling holes or too little discharged out the pressure side film cooling holes. Either way, the cooling of the blade is either too little or uses too much cooling air.

U.S. Pat. No. 5,660,524 issued to Lee et al on Aug. 26, 1997 and entitled AIRFOIL BLADE HAVING A SERPENTINE COOLING CIRCUIT AND IMPINGEMENT COOLING discloses a turbine blade with three separate cooling circuit that include a 2-pass serpentine flow circuit in the leading edge in which the second leg impinges cooling air onto a leading edge cavity connected to a showerhead arrangement of film cooling holes, a trailing edge cooling supply channel that is a single pass channel and connected to exit cooling holes along the trailing edge of the blade, and a 3-pass serpentine flow circuit with a first leg adjacent to the trailing edge cooling supply channel, a second leg forward of the first, and the third leg in the middle of the blade adjacent to the leading edge cooling circuit. The third leg provides impingement cooling to a pressure side impingement cavity and a suction side impingement cavity, with each of the impingement cavities having film cooling holes discharging cooling air onto the blade wall.

U.S. Pat. No. 6,206,638 B1 issued to Glynn et al on Mar. 27, 2001 and entitled LOW COST AIRFOIL COOLING CIRCUIT WITH SIDEWALL IMPINGEMENT COOLING CHAMBERS discloses a turbine blade with a 3-pass (triple pass) serpentine flow cooling circuit extending along the suction side wall and flowing in an aft to-forward direction, and in which each of the legs in the serpentine flow circuit impinges onto an impingement cavity located on the pressure side wall or the leading edge of the blade. Each impingement cavity includes film cooling holes.

U.S. Pat. No. 5,498,133 issued to Lee on Mar. 12, 1996 and entitled PRESSURE REGULATED FILM COOLING discloses a turbine airfoil such as a vane or a blade with two serpentine flow cooling circuit that share a common first leg channel, one flowing in the aft direction and the other flowing in the forward direction, and each channel is connected to an impingement cavity by a metering hole, and the cavities include film cooling holes.

None of the above cited prior art references anticipate nor make obvious the present invention in which a multiple pass serpentine flow cooling circuit provides convective cooling to surfaces of the airfoil on both the pressure side and the suction side that does not require film cooling as well as impingement cooling cavities with film cooling holes on surfaces of the airfoil on both sides that require film cooling while using a minimal amount of cooling air in order to increase the efficiency of the gas turbine engine.

It is therefore an object of the present invention to provide for a cooling air circuit for a turbine airfoil that provides increased cooling while using minimal amount of cooling air in order to increase the efficiency of the gas turbine engine.

It is another object of the present invention to provide for a cooling circuit within a turbine airfoil that can regulate the pressure and amount of cooling air flow in individual areas of the airfoil in order to provide adequate cooling without overcooling certain areas.

BRIEF SUMMARY OF THE INVENTION

A turbine blade used in a gas turbine engine having a serpentine flow cooling circuit with impingement cooling through metering holes connected to the serpentine flow cooling circuit. A showerhead arrangement is used to provide cooling to the leading edge region of the blade, and is supplied with cooling air through metering holes connected to a cooling supply channel. The serpentine flow cooling circuit has an upward flowing first leg adjacent to the leading edge region and is connected to a suction side impingement cavity through metering holes. A second leg is a downward flowing channel on the pressure side adjacent to the first leg channel, and is connected to a suction side impingement cavity through metering holes. A third leg of the serpentine flow cooling circuit is an upward flowing channel on the suction side of the blade and is connected to a pressure side impingement cavity through metering holes. A fourth let and a fifth leg of the serpentine flow circuit is a downward flowing channel and an upward flowing channel located in the trailing edge region of the blade and provides cooling for both the pressure side and suction side. The fifth leg channel includes a plurality of exit holes to discharge cooling air out from the trailing edge of the blade. The showerhead cooling circuit is separate from the serpentine flow cooling circuit. Film cooling holes connected to the first suction side impingement cavity and the second suction side impingement cavity provide film cooling for the suction side wall of the blade.

DETAILED DESCRIPTION OF THE INVENTION

Figure 1:
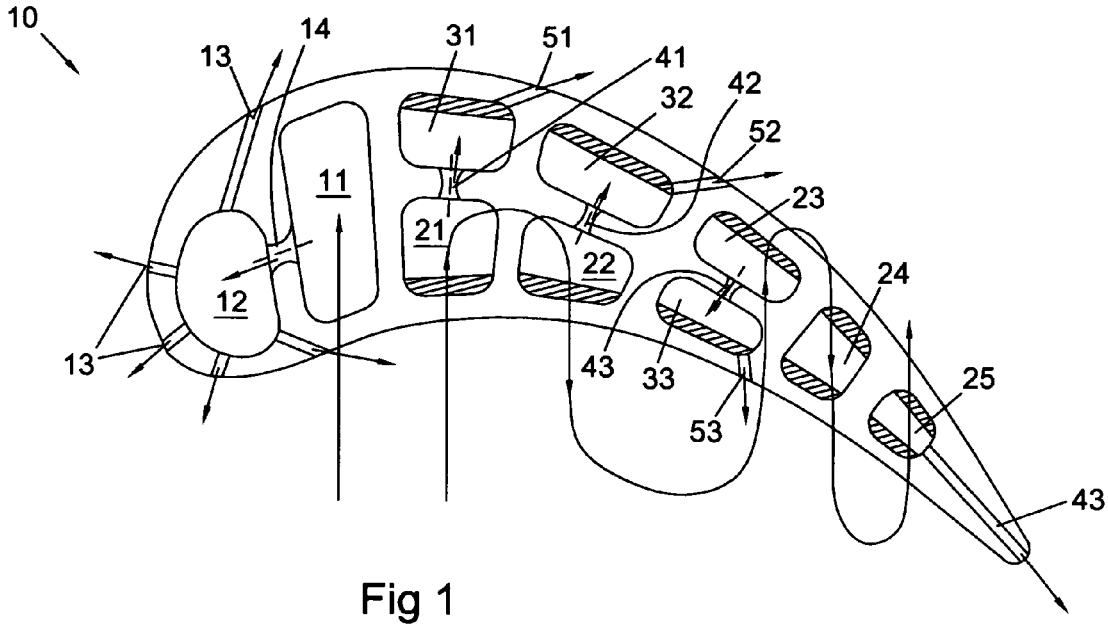
FIG. 1 shows a cross section view of the turbine blade serpentine flow cooling circuit of the present invention.

FIG. 1 shows the turbine blade with the serpentine flow cooling circuit of the present invention. A leading edge cooling supply channel 11 is located in the leading edge region of the blade and receives cooling air from an external source through cooling supply passages in the root of the blade. Metering holes 14 connect the leading edge cooling supply channel 11 with a leading edge cooling cavity 12, and five film cooling holes 13 that form a showerhead cooling arrangement discharge cooling air to the leading edge of the blade.

The remaining portion of the blade aft of the leading edge cooling circuit is cooled by the serpentine flow cooling circuit and impingement cavity arrangement described below. A first leg of the serpentine flow cooling circuit is an upward flowing cooling supply channel 21 located on the pressure side of the blade and is connected to the external source of cooling air. A second leg of the serpentine passage is a downward flowing cooling channel 22 on the pressure side of the blade. A third leg is an upward flowing channel 23 located on the suction side of the blade. A fourth leg is a downward flowing channel located between both the pressure side and suction side, with a fifth leg being an upward flowing channel located between the pressure and suction sides.

The serpentine flow cooling passage is thus formed from a series of channels that begins with the first leg channel 21 on the pressure side, the second leg channel 22 also on the pressure side, the third leg 23 now on the suction side, and then the fourth and fifth legs 24 and 25 that are positioned between both the pressure and suction sides. Three impingement cavities are included to make up the serpentine flow and impingement cooling circuit of the blade. A first impingement cavity 31 is located on the suction side and opposed to the first leg 21 of the serpentine flow circuit. Metering and impingement holes 41 connect the first impingement cavity 31 to the first leg channel 21. A second impingement cavity 32 is located on the suction side and opposed to the second leg channel 22, and connected to the second leg channel 22 by a plurality of metering and impingement holes 42. A third impingement cavity 33 is located on the pressure side of the blade and opposed to the third leg channel 23. A plurality of metering and impingement holes 43 connects the third impingement cavity 33 to the third leg channel 23. The fifth leg channel 25 is connected to a plurality of exit holes extending along the trailing edge of the blade. In this embodiment, film cooling holes are used in the first impingement cavity 31 and the second impingement cavity 32 to discharge film cooling air to the external wall on the suction side. Trip strips are used in the channels and cavities to promote heat transfer from the hot wall surface to the cooling air. Pin fins can also be used within the cooling supply channels 21-25 if desired to promote heat transfer. The pressure side and the suction side channels 21-23 and 31-33 have substantially the same blade chordwise length as the channel on the opposite side of the blade. Pressure side channel 21 has substantially the same chordwise length as suction side channel 31, and pressure side channel 22 has substantially the same chordwise length as suction side channel 32. Because of the blade curvature in the pressure side direction, the suction side channels will have a longer chordwise length than the pressure side channels.

Figure 2:
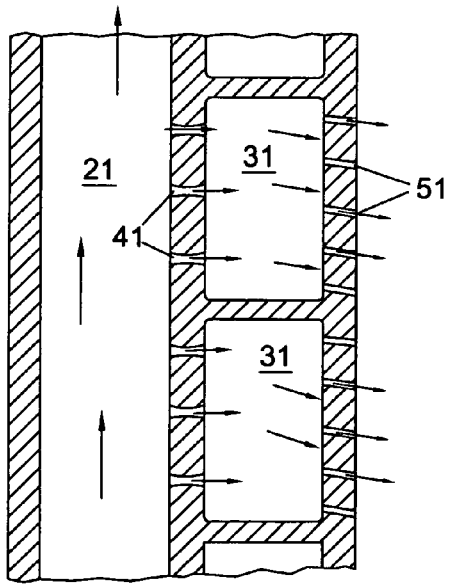
FIG. 2 shows a cut-away view of the first leg of the serpentine flow path and two of the impingement cavity compartments connected through the metering and impingement holes.

Each of the legs or channels 21-25 that form the serpentine flow path are continuous channels. The impingement cavities 31-33 are formed from a series of compartments along the airfoil spanwise direction which is basically parallel to the supply channels. FIG. 2 shows a cut-away view of a portion of the first leg supply channel 21 and two of the impingement cavity compartments 31 connected by a plurality of metering and impingement holes 41. Depending upon the size of the blade, 3 to 5 compartments can be used to extend along the channel. Each compartment can have around 5 metering and impingement holes 41. Also, the number of film cooling holes per compartment 31 would depend upon the size of the compartment and the film cooling requirements. By breaking the cavity into compartments, each compartment can designed for a specific pressure and flow level by sizing the metering and impingement holes 41 and the film cooling holes 51.

Cooling air is supplied to the serpentine flow and impingement cooling circuit through the first cooling supply channel 21, and a portion of the cooling air is metered through the impingement holes 41 and into the first impingement cavity 31 and impinged onto the airfoil suction sidewall to provide backside impingement cooling. The cavity pressure is regulated by the impingement holes 41 to provide good pressure ratio across the suction side film holes 51. This allows for the formation of good film sub-boundary layer for the airfoil external film cooling. The cooling air flows in a serpentine path down the pressure side mid-chord channel, and impinges again onto the suction side cooling cavity in the second impingement cavity 32. The cooling air then flows through the airfoil suction side channel in the third leg 23 down stream of the gage point on the airfoil and the impingement and pressure regulation process is continued. The remaining cooling air then flows in a serpentine path through the narrow section of the airfoil trailing edge region through the fourth and fifth legs 24 and 25 and finally discharged through the trailing edge cooling holes 43 to provide cooling for the trailing edge section. Turbulators members such as trip strips are used within the impingement cavities 31-33 and the cooling channels 21-25 for the enhancement of internal cooling performance. The inventive cooling arrangement of the present invention maximizes the use of cooling air by tailoring the cooling design to the airfoil heat load and external pressure profile. The metering and impingement holes 41-43 and the film cooling holes can be individually sized to regulate the pressure and air flows out of the film cooling holes to provide more cooling to some parts of the airfoil and less cooling to other parts. Hot spots can be provided with more cooling while not-hot spots can be provided with less.

For a turbine blade, film cooling is needed on locations of the pressure side and suction side of the blade 10 in which the film cooling holes 51-53 are located. The first leg 21 and second leg 22 of the serpentine flow circuit or path through the blade uses the coolest air since the air entering channel 21 is fresh and unheated (other than being heated from work done by the compressor) and therefore does not require film cooling holes. the first and second legs or channels 21 and 22 feed cooling air to the first and second impingement cavities 31 and 32 located on the suction side of the blade and where film cooling is required. Both convection and impingement cooling is used in the impingement cavities 31 and 32 to provide more cooling to this part of the blade. because of the film cooling hole 53 located on the pressure side, the serpentine flow path then flips over from the pressure side to the suction side to provide for the third impingement cavity 33 to supply the film cooling air to the film cooling hole 53. the third channel 32 can be located on this location of the suction side because the channel 23 is located downstream from the gage point of the blade where no further film cooling is required. The remaining channels 24 and 25 provide convection cooling for the trailing edge region and discharge cooling air out from the exit cooling holes 43. Thus, a single serpentine flow path can be used to provide for the cooling air flow through the blade. This is beneficial since the cross sectional area of the serpentine flow path can be changed so that the flow velocity remains above a certain level to maximize the heat transfer effect into the cooling air. The pressure and flow rate through the serpentine path can therefore be controlled by design. Also, the flow and pressure into the impingement cavities can be controlled by sizing the metering and impingement holes 41-43. Thus, the proper amount and pressure of cooling air can be controlled over the entire blade pressure and suction side surface and within the cooling air passages. The cooling effect can be maximized while the amount of cooling air used minimized. Therefore, the efficiency of the engine can be increased. The invention has been described for use with a turbine blade. However, the serpentine flow cooling circuit arrangement with impingement cavities and film cooling holes could also be used in a stator vane that requires internal cooling and film cooling.

I claim:

1. A turbine blade for use in a gas turbine engine, the blade comprising: an airfoil having a pressure side and a suction side; a first row of film cooling holes located on the suction side of the blade; a first impingement cavity located to provide impingement cooling on the suction side wall of the blade and in fluid communication with the first row of film cooling holes; a second row of film cooling holes located on the pressure side of the blade; a second impingement cavity located to provide impingement cooling on the pressure side wall of the blade and in fluid communication with the second row of film cooling holes;

a serpentine flow cooling path comprising a first cooling supply channel located on the pressure side of the blade and opposed to the first impingement cavity; a first metering and impingement hole to connect the first cooling supply channel to the first impingement cavity; the serpentine flow cooling path further comprising a second cooling supply channel located on the suction side of the blade and opposed to the second impingement cavity; and, a second metering and impingement hole to connect the second cooling supply channel to the second impingement cavity.

2. The turbine blade of claim 1, and further comprising: a third row of film cooling holes located on the suction side of the blade and downstream from the first row of film cooling holes;

a third impingement cavity located to provide impingement cooling on the suction side wall of the blade and in fluid communication with the third row of film cooling holes; the serpentine flow cooling path further comprising a third cooling supply channel located on the pressure side of the blade and opposed to the third impingement cavity; and, a third metering and impingement hole to connect the third cooling supply channel to the third impingement cavity; and, the serpentine flow path flows from the first cooling supply channel, into the third channel, and then into the second channel.

3. The turbine blade of claim 2, and further comprising: each of the impingement cavities is formed from a plurality of compartments arranged substantially along a spanwise direction of the blade in parallel to the associated cooling supply channel; and, each of the compartments being in fluid communication with the respective cooling supply channel through at least one metering and impingement hole.

4. The turbine blade of claim 3, and further comprising: the serpentine flow path further comprising a fourth cooling supply channel extending along the trailing edge portion of the blade between both the pressure side and the suction side walls; and, a plurality of exit holes spaced along the trailing edge of the blade and in fluid communication with the fourth cooling supply channel.

5. The turbine blade of claim 4, and further comprising: a leading edge cooling supply channel; a leading edge cooling cavity located between the leading edge cooling channel and the leading edge of the blade; a metering hole to provide fluid communication between the leading edge cooling channel and the leading edge cooling cavity; and, a showerhead cooling arrangement with film cooling holes in the leading edge region of the blade and in fluid communication with the leading edge cooling cavity.

6. The turbine blade of claim 5, and further comprising: the leading edge cooling supply channel is separate from the serpentine flow cooling path such that the cooling air does not mix.

7. The turbine blade of claim 6, and further comprising: the pressure side channels have substantially the same blade chordwise length as the suction side channels.

8. The turbine blade of claim 1, and further comprising: each of the impingement cavities is formed from a plurality of compartments arranged substantially along a spanwise direction of the blade in parallel to the associated cooling supply channel; and, each of the compartments being in fluid communication with the respective cooling supply channel through at least one metering and impingement hole.

9. The turbine blade of claim 1, and further comprising: the serpentine flow path further comprising a fourth cooling supply channel extending along the trailing edge portion of the blade between both the pressure side and the suction side walls; and, a plurality of exit holes spaced along the trailing edge of the blade and in fluid communication with the fourth cooling supply channel.

10. The turbine blade of claim 1, and further comprising: a leading edge cooling supply channel; a leading edge cooling cavity located between the leading edge cooling channel and the leading edge of the blade; a metering hole to provide fluid communication between the leading edge cooling channel and the leading edge cooling cavity; and, a showerhead cooling arrangement with film cooling holes in the leading edge region of the blade and in fluid communication with the leading edge cooling cavity.

11. The turbine blade of claim 1, and further comprising: the pressure side channels have substantially the same blade chordwise length as the suction side channels.

* * * * *